United States Patent [19]

Perreault

[11] Patent Number: 5,025,557

[45] Date of Patent: Jun. 25, 1991

[54] LOCKING FOLDING KNIFE

[76] Inventor: Daniel C. Perreault, 1924 165th Ct. SE., Bellevue, Wash. 98008

[21] Appl. No.: 467,200

[22] Filed: Jan. 18, 1990

[51] Int. Cl.[5] ..... B26B 1/04

[52] U.S. Cl. ..... 30/151; 30/161; 30/162

[58] Field of Search ..... 30/131, 155, 160, 161, 30/162

[56] References Cited

U.S. PATENT DOCUMENTS

| | | | |
|---|---|---|---|
| 2,507,019 | 5/1950 | Johnson . | |
| 2,924,879 | 2/1960 | Kraus, Jr. . | |
| 3,702,501 | 11/1972 | Wood | 30/161 |
| 3,868,774 | 3/1975 | Miori | 30/161 |
| 4,083,110 | 4/1978 | Goldin et al. | 30/155 |
| 4,167,811 | 9/1979 | Barrett | 30/161 |
| 4,451,982 | 6/1984 | Collins | 30/161 |
| 4,535,539 | 8/1985 | Friedman et al. | 30/161 |
| 4,536,959 | 8/1985 | Ross | 30/161 |
| 4,612,706 | 9/1986 | Yunes | 30/160 |
| 4,669,188 | 6/1987 | Evrell | 30/161 |
| 4,811,486 | 3/1989 | Cunningham | 30/161 |

*Primary Examiner*—Douglas D. Watts

*Attorney, Agent, or Firm*—Seed and Berry

[57] ABSTRACT

A folding knife has a blade that pivots so that the cutting edge may be protected within the handle or extended for use. The blade has an extended tang which may be locked into the handle when the cutting edge is extended. The knife can be disassembled without tools for cleaning.

20 Claims, 5 Drawing Sheets

LOCKING FOLDING KNIFE

TECHNICAL FIELD

The invention relates to folding knives. More specifically, the invention relates to folding knives with blade locking mechanisms.

BACKGROUND OF THE INVENTION

Folding knives generally have a provision to hold their blades in the open or closed positions. Locking mechanisms are frequently used to hold the blade open securely during use, and to keep the blade safely closed.

A typical locking mechanism is found on a knife with a blade that pivots about a pin contained in its handle, the pin passing through a hole in the blade. The blade is provided with a notch or flat surface near the pivot hole which may be engaged by a bolt or catch to prevent opening or closing. However, due to the short distance typically provided between the pivot hole and the notch, a given torque, when applied to the locked blade, will create substantial forces on the locking mechanism thereby causing loosening, wear, or failure.

Further, because the blade is fixed only at two points (that is, the pivot hole and the notch) it is susceptible to wobble and play when lateral or torsional forces are applied, especially as the mechanism wears.

An additional drawback of existing folding knives is that they are difficult to clean. Folding knives are generally not provided with means for disassembly to permit cleaning, due to the complexity of the locking mechanisms and the need for permanent rigidity of construction. Therefore, they are difficult to clean, especially in the field, where it may be most necessary.

In part because of the limitations described above, current folding knives are often too weak to withstand substantial force and a rigid, one-piece knife must be used. However, one-piece knives require the use of a scabbard for safety, and the knife may not be converted to a more compact form for storage.

In view of the above, there is a need for an improved folding knife that provides improved locking, better blade stability, and easier disassembly for cleaning.

SUMMARY OF THE INVENTION

It is the object of the invention to provide a lockable folding knife that may be used in applications where substantial forces are to be transmitted or resisted.

It is also an object of the invention to provide a lockable folding knife that will resist wear caused by heavy use, thereby providing rigidity throughout a long product life.

It is yet another object of the invention to provide a folding knife that can be easily disassembled for cleaning, preferably without tools.

The present invention achieves these advantages, as well as other objects and advantages which will become apparent from the description which follows, by providing an improved folding knife design. In a preferred embodiment, a folding knife has a blade having an open position and a closed position. The blade has a tang portion and a cutting portion, and is rotatably attached to the handle at a pivot point on the tang portion near the cutting portion. The blade also has a fixing point near the end of the tang. The fixing point may be fixed in the handle when the knife is open. The cutting portion of the blade is secured in the handle when the knife is closed.

DETAILED DESCRIPTION OF THE INVENTION

Figure 2:
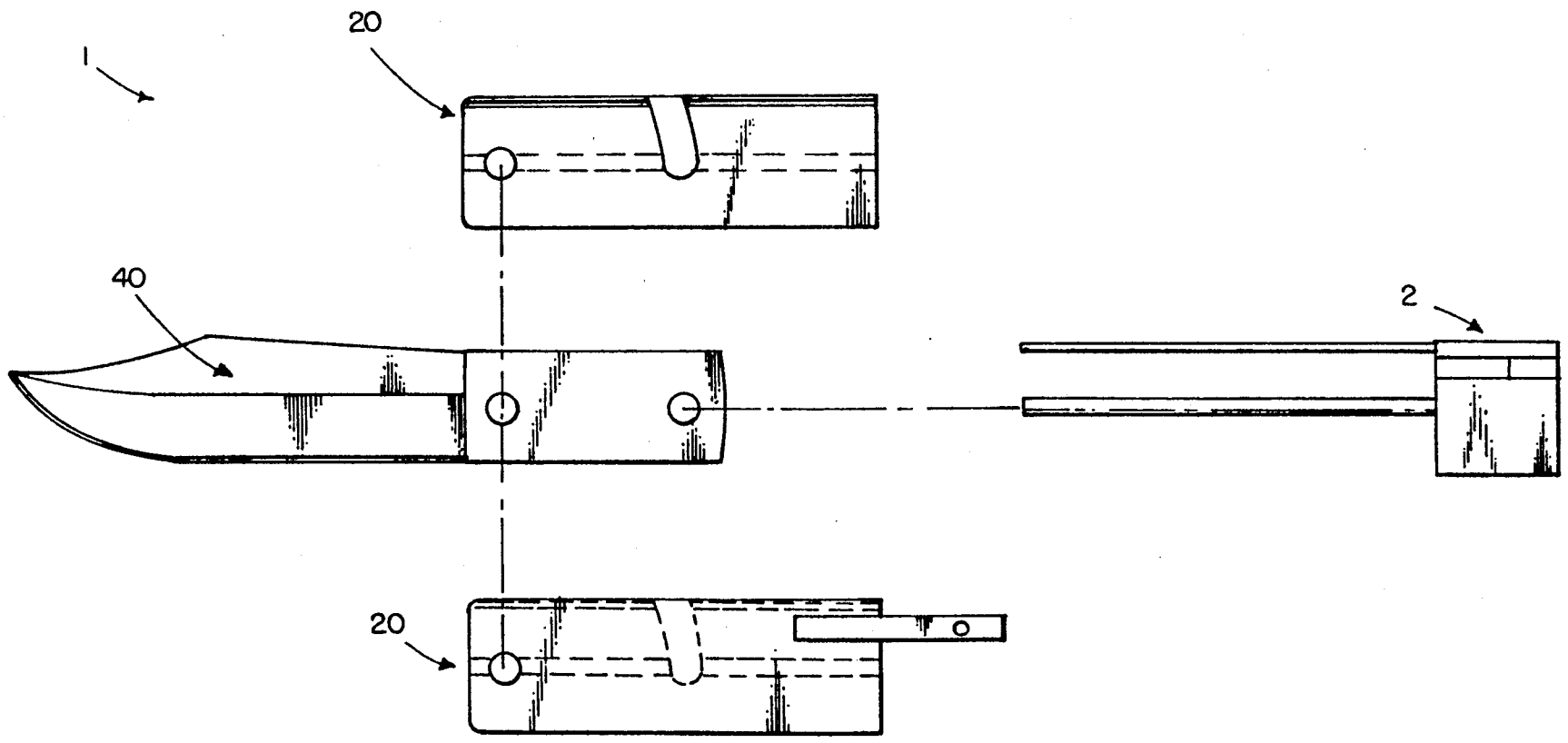
FIG. 2 is an exploded side elevation view.

A folding knife 1 comprising a preferred embodiment of the present invention is illustrated in FIG. 2 and includes a handle base 2, a pair of handle plates 20, and a blade 40.

Figure 3:
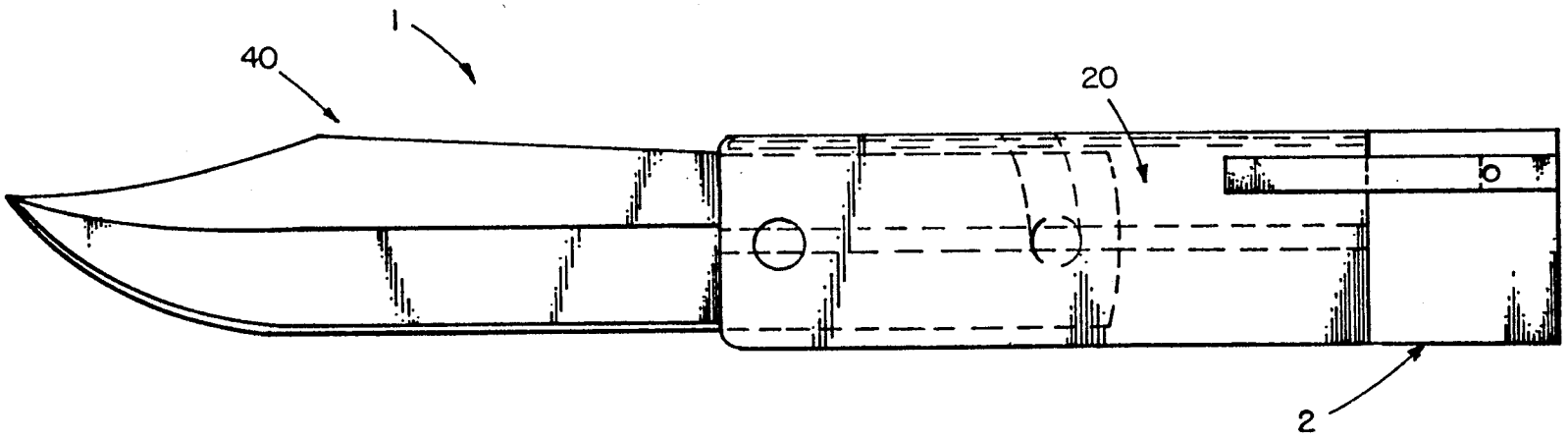
FIG. 3 is a side elevation view of the knife in the open position.

FIG. 3 shows the knife in the open position, with the handle plates positioned on opposite sides of the blade and engaged by the handle base, shown in its locked position.

Figure 4:
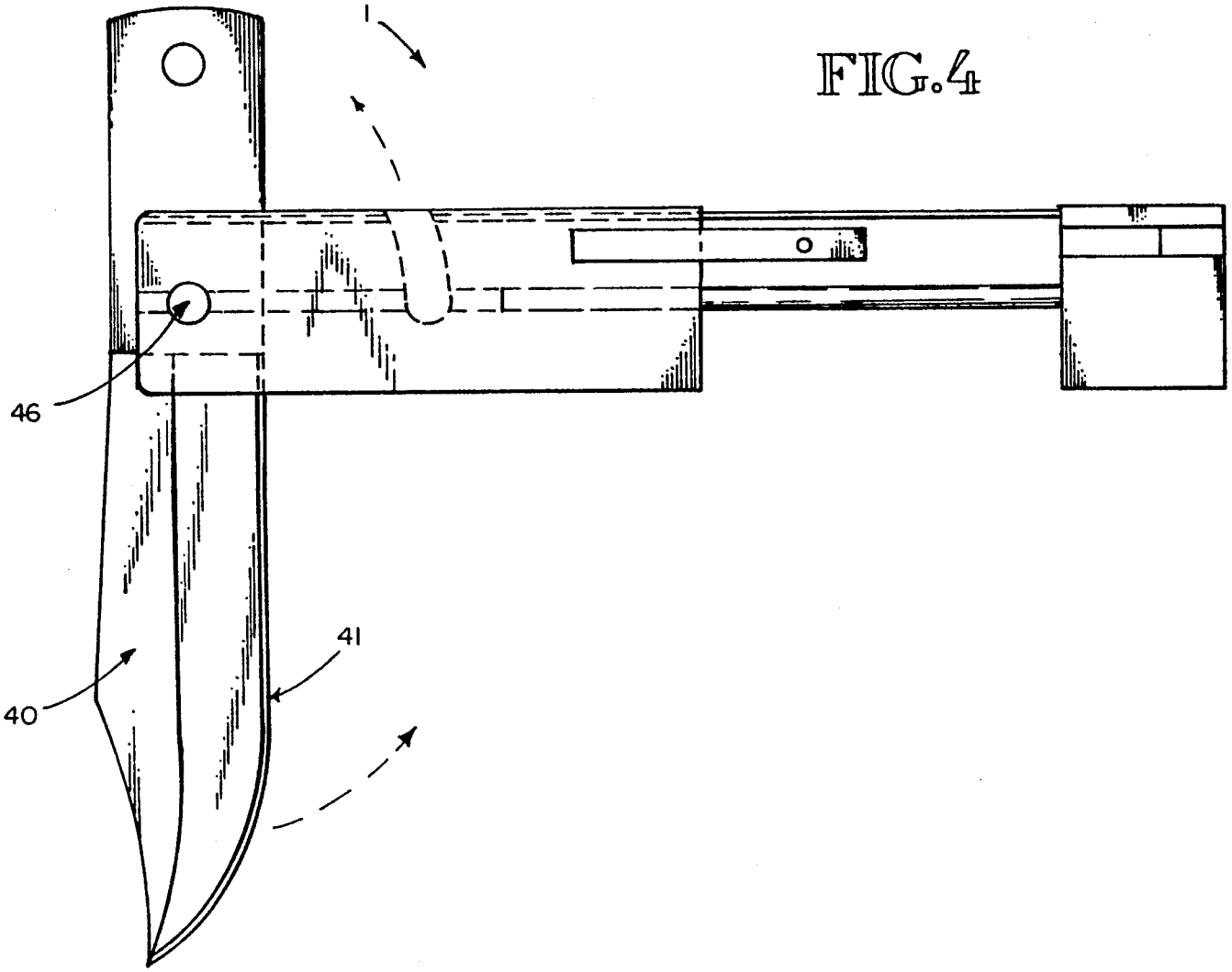
FIG. 4 is a side elevation view of the knife in transition between the open and closed positions, and with the handle base in the unlocked position.

When the knife is to be closed, the handle base may be substantially withdrawn from the handle plates to its unlocked position, as shown in FIG. 4, and the blade may be rotated. As viewed in FIG. 4, a full counterclockwise rotation of the blade about pivot pins 46 will place the cutting edge 41 of the blade 40 between the handle plates. By pushing the handle base back into contact with the handle plates 20, the knife returns to the closed position.

Figure 5:
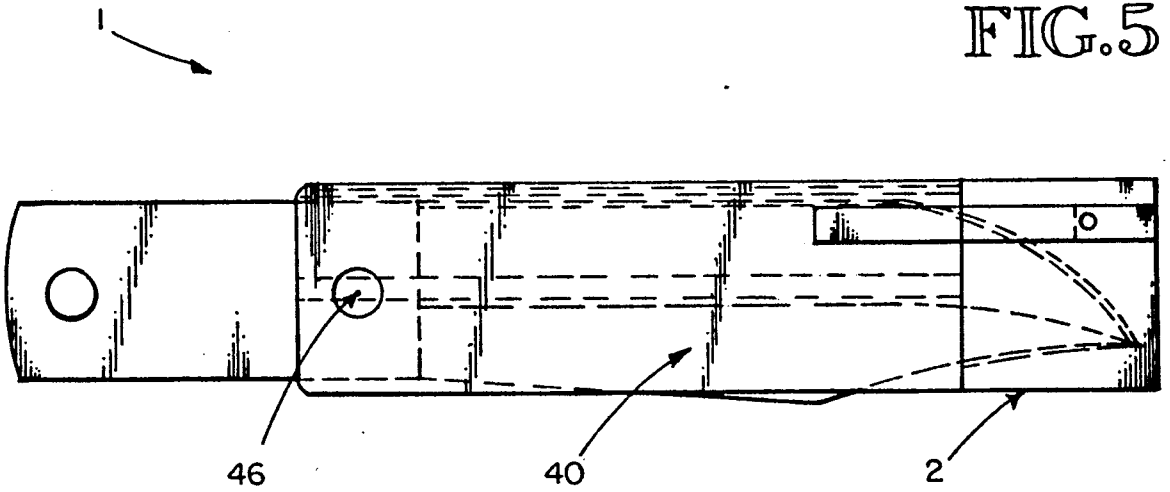
FIG. 5 is a side elevation view of the knife in the closed position.

FIG. 5 shows the knife in the closed position, with the blade fully rotated to its closed position and the handle base in its locked position.

Figure 1:
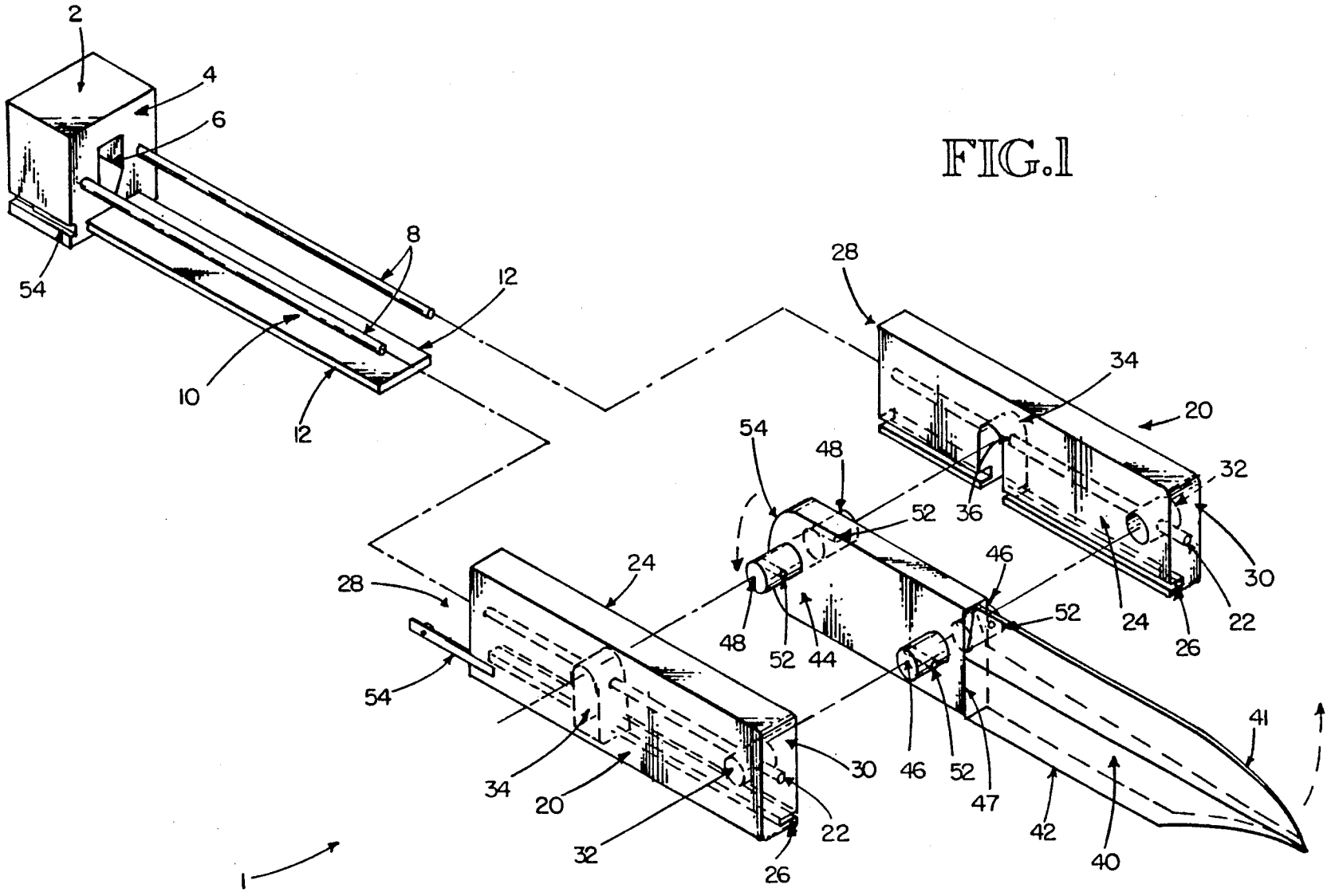
FIG. 1 is an exploded isometric view of the invention.

FIG. 1 illustrates in detail the component parts of a preferred embodiment of the invention. The handle base has an interior face 4 with a recessed cavity 6 centrally located therein. A pair of guide pins 8 protrude perpendicularly from the interior face. The guide pins are located on opposite sides of the recessed cavity. A blade guard 10 having two blade guard edges 12 protrudes perpendicularly from the interior face.

Each handle plate has a guide hole 22 running centrally therein, oriented parallel to the length of each plate and slidably receiving one of the guide pins. The handle plates have inner faces 24 which are parallel to and which face each other. Each handle plate has a blade guard groove 26 oriented parallel to the guide hole, located on the inner face, and running along its entire length so that each blade guard groove slidably receives a blade guard edge. Each handle plate has a base end 28 and a forward end 30, with the base end oriented nearer the handle base. Each handle plate is provided with a pivot hole 32 centrally intersecting the guide hole and located near the forward end of the handle plate. Each handle plate has an arc recess 34 having a depth slightly less than the thickness of the handle plate, formed in the inner face, and located generally near the center of the length of the handle plate. Each arc recess forms an arc centered on the pivot hole. Each arc recess is terminated on one end by an arc end radius 36 having a radius equal to one-half the width of the arc recess and centrally intersecting the guide hole. The other end of each arc recess continues through the edge of the inner face nearest the blade guard groove.

A blade 40 having a cutting portion 42 and a tang 44 is positioned between the inner faces of the handle plates. A pair of pivot pins 46 are coaxially positioned on opposite sides of the tang near the base 47 of the cutting portion and centrally located along the length of the tang. The pivot pins are slidably and rotatably received by the pivot holes of the handle plates. A pair of fixing pins 48 are similarly coaxially positioned on opposite sides of the tang near the tang end 50 and centrally located along the length of the tang in line with pivot pins.

The pivot pins and the fixing pins are provided with pin holes 52 which are sized and positioned to receive slidably the guide pins.

The cutting portion of the blade is sized so that when the handle base is partially inserted into the handle plates and the blade is pivoted one-half revolution, the cutting portion will contact the blade guard. The recessed cavity is sized to permit the handle base then to be further inserted into the handle plates, thereby capturing the tip of the blade portion within the recessed cavity.

A spring lock 54 is provided on the handle base and one of the handle plates to hold (the handle base securely) in the locked position.

It is also contemplated that the invention as described above be applied to knives of different varieties. Therefore, the invention is not to be limited by the above description, but is to be determined in scope by the claims which follow.

I claim:

1. A folding knife having an open position and a closed position, the knife having:

a handle; and a blade having a tang portion and a cutting portion, the blade being rotatably attached to the handle at a pivot point located on the tang portion near the cutting portion, and the blade having a fixing point spaced apart from the pivot point and located on the tang portion at a position remote from the cutting portion, the fixing point being selectably fixable to the handle when the knife is in the open position, and the cutting portion being securely received within the inner cavity of the handle when the knife is in the closed position wherein the distance between said pivot point and said fixing point is at least one quarter the distance between said pivot point and the end of said blade.

2. The knife of claim 1 wherein the blade is easily removable from the handle.

3. The knife of claim 1 wherein the pivot point comprises a pivot pin fixed to the blade and a pivot hole formed in the handle rotatably to receive the pivot pin and wherein the fixing point protrudes outwardly from said blade.

4. The knife of claim 3 wherein similar pivot points are provided on each side of the blade.

5. A folding knife having an open position and a closed position, the knife having:

a handle; and a blade having a tang portion and a cutting portion, the blade being rotatably attached to the handle at a pivot point located on the tang portion near the cutting portion, and the blade having a fixing point spaced apart from the pivot point and located on the tang portion at a position remote from the cutting portion, the fixing point being selectably fixable to the handle when the knife is in the open position, and the cutting portion being securely received within the inner cavity of the handle when the knife is in the closed position wherein the fixing point comprises a fixing pin fixed to the blade and an arc recess formed in the handle to permit the fixing pin to move through an arc about the pivot point as the knife is rotated from its closed position to its open position, the arc recess having an end radius sized and positioned to stop the fixing pin when the knife is in the proper open position.

6. The knife of claim 5 wherein similar fixing points are provided on either side of the blade.

7. The knife of claim 5 wherein the pivot pin and the fixing pin are provided with guide pin holes perpendicular to each pin's axis on a line passing through the center of each pin and parallel to the blade.

8. The knife of claim 7 wherein the handle comprises:

a pair of side plates which are positioned on opposite sides of and in parallel contact with the blade, the plates being configured to engage the blade at the pivot point and at the fixing point; and a handle base which engages the side plates, the handle base having a locked position and an unlocked position.

9. The knife of claim 8 wherein the handle base has locking means for locking the handle base in the locked position.

10. The knife of claim 8 wherein the side plates are each provided with a guide hole running through its length and coaxially with the guide pin holes when the knife is in the open position, the guide holes being generally the same size as the guide pin holes.

11. The knife of claim 10 wherein the handle base includes a pair of guide pins positioned to be slidably received within the guide holes of the side plates, the guide pins being of sufficient length to extend through the pivot pins and the fixing pins when the knife is in the open position and the handle base is in the locked position.

12. The knife of claim 11 wherein the handle base has a blade guard which engages the cutting portion of the blade when the blade is rotated into the knife-closed position and protects the cutting portion from outside contact when the knife is in the closed position.

13. The knife of claim 12 wherein the side plates are each provided with a slot to slidably receive the blade guard.

14. The knife of claim 12 wherein the guide pins and the blade guard are of such a length that they do not extend beyond the side plates when the handle base is in the locked position and they do not engage either the pivot pins or the fixing pins when the handle base is in the unlocked position.

15. The knife of claim 8 wherein the handle base includes a recessed cavity which captures the point of the cutting portion of the blade when the blade is in the knife-closed position and the handle base is shifted to the locked position.

16. A folding knife having an open position and a closed position, the knife having:

a removable blade having a tang portion of substantial length and a cutting portion wherein the blade is rotatably attached to the handle at a pivot point located on the tang portion near the cutting portion, the pivot point comprising a pivot pin fixed to the blade and a pivot hole formed in each side of the handle to receive the pivot pin, thereby providing a bearing surface on each side of the blade, the pivot pin and the fixing pin being provided with guide pin holes perpendicular to each pin's axis on a line passing through the center of each pin and parallel to the blade, and the blade having a fixing point comprising a fixing pin fixed to the tang portion at a position remote from the cutting portion;

a handle having an inner cavity, the handle comprising:

a pair of side plates, each provided with a guide hole running through its length and being coaxial with the guide pin holes when the knife is in the open position, the guide holes being generally the same size as the guide pin holes, the side plates each being provided with a slot to slidably receive the blade guard, wherein the side plates are positioned on opposite sides of and in parallel contact with the blade, the plates being configured to engage the blade at the pivot point and at the fixing point; and a handle base which engages the side plates, the blade base having a blade guard which engages the cutting portion of the blade when the blade is rotated into the knife-closed position and protects the cutting portion from outside contact when the knife is in the closed position, the handle base having a pair of guide pins positioned to be slidably received within the guide holes of the side plates, the guide pins being of sufficient length to extend through the pivot pins and the fixing pins when the knife is in the open position and the handle base is in the locked position, the handle base having a recessed cavity which captures the point of the cutting portion of the blade when the blade is in the knife-closed position and the handle base is shifted to the locked position; the handle base having a locked position and an unlocked position, and being provided with locking means for locking the handle base in the locked position; and wherein the fixing point is selectably fixable to the handle when the knife is in the open position, and the cutting portion being securely received within the inner space of the handle when the knife is in the closed position.

17. A folding knife having an open position and a closed position, the knife having:

a blade having a tang portion and a cutting portion, the tang having two spaced-apart points, a pivot point and a fixing point, said tang portion extending on the opposite side of said pivot point from said cutting portions; and a handle having rotation means for rotatably engaging the blade at the pivot point, and having locking means for selectably fixing the blade at the fixing point, said handle being easily removable from said blade wherein the handle includes a pair of handle plates positioned on opposite sides of the blade.

18. A folding knife having an open position and a closed position, the knife having:

a blade having a tang portion and a cutting portion, the tang having two spaced-apart points, a pivot point and a fixing point, said tang portion extending on the opposite side of said pivot point from said cutting portions; and a handle having rotation means for rotatably engaging the blade at the pivot point, and having locking means for selectably fixing the blade at the fixing point, said handle being easily removable from said blade wherein the handle includes a handle base having a locked position and an unlocked position, whereby the fixing means fixes the blade at the fixing point when the handle base is in the locked position and the knife is in the open position, and whereby the blade may freely rotate about the pivot point when the handle base is in the unlocked position.

19. A folding knife having an open position and a closed position, the knife having:

a blade having a tang portion and a cutting portion, the tang having two spaced-apart points, a pivot point and a fixing point, said tang portion extending on the opposite side of said pivot point from said cutting portions; and a handle having rotation means for rotatably engaging the blade at the pivot point, and having locking means for selectably fixing the blade at the fixing point, said handle being easily removable from said blade wherein said locking means is easily removable from said blade and said handle.

20. A folding knife having an open position and a closed position, the knife having:

a blade having a tang portion and a cutting portion, the tang having two spaced-apart points, a pivot point and a fixing point, said tang portion extending on the opposite side of said pivot point from said cutting portions; and a handle having rotation means for rotatably engaging the blade at the pivot point, and having locking means for selectably fixing the blade at the fixing point, said handle being easily removable from said blade wherein the distance between said pivot point and said fixing point is at least one quarter the distance between said pivot point and the end of said blade.

* * * * *